US008975551B2

(12) United States Patent
Kaulfuss et al.

(10) Patent No.: US 8,975,551 B2
(45) Date of Patent: Mar. 10, 2015

(54) ARC CHAMBER FOR A CIRCUIT BREAKER AND CIRCUIT BREAKER HAVING AN ARC CHAMBER

(75) Inventors: Guenter Kaulfuss, Falkensee (DE); Volker Lehmann, Treuenbrietzen (DE); Karl Mascher, Berlin (DE); Peter Milewski, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 192 days.

(21) Appl. No.: 13/522,359

(22) PCT Filed: Jan. 6, 2011

(86) PCT No.: PCT/EP2011/050127

§ 371 (c)(1),
(2), (4) Date: Jul. 16, 2012

(87) PCT Pub. No.: WO2011/086028

PCT Pub. Date: Jul. 21, 2011

(65) Prior Publication Data

US 2012/0292291 A1 Nov. 22, 2012

(30) Foreign Application Priority Data

Jan. 15, 2010 (DE) ..... 10 2010 005 090

(51) Int. Cl.
*H01H 33/66* (2006.01)
*H01H 33/24* (2006.01)
*H01H 33/53* (2006.01)

(52) U.S. Cl.
CPC ..... *H01H 33/24* (2013.01); *H01H 33/53* (2013.01)
USPC ..... 218/118; 218/139; 218/147

(58) Field of Classification Search
USPC ..... 218/118–119, 134–139, 147
See application file for complete search history.

(56) References Cited

U.S. PATENT DOCUMENTS

| | | | | |
|---|---|---|---|---|
| 4,249,050 | A * | 2/1981 | Okumura | 218/147 |
| 4,351,990 | A * | 9/1982 | Hesselbart et al. | 200/50.22 |
| 5,852,266 | A * | 12/1998 | Komuro et al. | 218/119 |
| 6,410,875 | B2 * | 6/2002 | Allard et al. | 218/118 |
| 8,237,075 | B2 * | 8/2012 | Isoya et al. | 218/134 |
| 2004/0104201 | A1 * | 6/2004 | Sato et al. | 218/118 |
| 2007/0272659 | A1 | 11/2007 | Saxl et al. | |
| 2011/0000886 | A1 * | 1/2011 | Isoya et al. | 218/139 |

FOREIGN PATENT DOCUMENTS

| | | | |
|---|---|---|---|
| CN | 101116163 | A | 1/2008 |
| DE | 1 170 039 | B | 5/1964 |
| DE | 1170039 | B | 5/1964 |
| DE | 1 182 412 | B | 11/1964 |
| DE | 1182412 | B | 11/1964 |
| DE | 26 26 436 | A1 | 12/1977 |

(Continued)

*Primary Examiner* — Truc Nguyen
(74) *Attorney, Agent, or Firm* — Laurence A. Greenberg; Werner H. Stemer; Ralph E. Locher

(57) ABSTRACT

An arc chamber for a circuit breaker has first and second mounting bodies. The mounting bodies are disposed at the ends of an electrically insulating insulation section of the arc chamber. The insulation section is formed of at least two shell-shaped partial sections. The partial sections are curved concavely relative to a longitudinal axis of the arc chamber. A gap is formed between the edges of the bodies of the partial sections.

14 Claims, 3 Drawing Sheets

(56) References Cited

FOREIGN PATENT DOCUMENTS

| | | | |
|---|---|---|---|
| DE | 2626436 | A1 | 12/1977 |
| DE | 103 45 657 | A1 | 4/2005 |
| EP | 0 513 945 | A1 | 11/1992 |
| EP | 1 519 395 | A2 | 3/2005 |
| JP | H07326265 | A | 12/1995 |
| WO | 2009125467 | A1 | 10/2009 |

* cited by examiner

ARC CHAMBER FOR A CIRCUIT BREAKER AND CIRCUIT BREAKER HAVING AN ARC CHAMBER

BACKGROUND OF THE INVENTION

Field of the Invention

The invention relates to an arc chamber for a circuit breaker having a first and a second mounting body, which, at each end referred to a longitudinal axis of the arc chamber, abut an electrically insulating insulating section of the arc chamber; and to a circuit breaker having an arc chamber.

An example of an arc chamber is disclosed in patent specification DE 103 45 657 B4. An arc chamber for a circuit breaker which has an electrically insulating insulating section between two mounting bodies arranged at the ends, is described therein. At the same time, the insulating section is tubular in shape, wherein tube walls of the insulating section are penetrated by penetrating recesses.

The production of an arc chamber of this kind is comparatively laborious, particularly with regard to the production of the insulating section. Handling in the production process is difficult due to the tubular structure. Positioning and fixing the position of the recesses on the insulating section is laborious.

Furthermore, the structure of the insulating section is fixed once the recesses have been made in the known insulating section. Variations of the recesses with regard to position, shape etc. can only be carried out to a limited extent after they have been made. In particular, when there are a large number of variants of insulating sections with recesses which differ from one another, a large number of insulating sections must be kept available and then connected to mounting bodies as required.

BRIEF SUMMARY OF THE INVENTION

The object of the invention is therefore to specify an arc chamber which enables production to be carried out more cost effectively.

According to the invention, this is achieved with an arc chamber of the kind mentioned in the introduction in that the insulating section has at least two shell-shaped partial sections which in each case are curved concavely with respect to the longitudinal axis, and edges of the bodies of the partial sections are spaced apart from one another in such a way that at least one gap is formed in the insulating section between the partial sections.

Dividing the insulating section into a plurality of shell-shaped partial sections enables a gap to be formed between the partial sections themselves so that it is unnecessary to make a cutout in the individual partial section itself for forming a recess. Surfaces of the shell-shaped partial sections which face the longitudinal axis are formed in the manner of a trough and run substantially in the direction of the longitudinal axis. At the same time, the trough is open in the direction of the longitudinal axis, thus resulting in a concave curvature of the partial sections on the side thereof which faces the longitudinal axis. In doing so, the concavely curved region is free from overlaps so that an inner accommodation space of the arc chamber is bounded around the longitudinal axis due to the interaction of the plurality of partial sections.

At the same time, the insulating sections preferably have a cross section which corresponds to a circular ring segment. In doing so, the segment encompasses a maximum angular range of 180°.

The use of at least two partial sections, which are designed in the manner of half-shells for example, enables the formation of an insulating section, which on the one hand is bounded by the partial sections and, on the other, provides at least one gap between the edges of the bodies of the partial sections, through which, for example, a fluid can flow. A possible example of a fluid of this kind is an electrically insulating liquid or an electrically insulating gas which flows through the arc chamber and adjacent regions.

It can be provided that a gap is always formed between mutually facing edges of the bodies of adjacent partial sections. It can however also be provided that partial sections which are arranged adjacent to one another butt together and therefore, instead of an effective gap, a closed surface with a butt joint is formed, whereas a gap is formed on another side between two immediately adjacent partial sections.

A further advantageous embodiment can provide that convex outer sleeve surfaces of the partial sections define a rotationally symmetrical envelope between the mounting bodies.

A convex outer sleeve surface enables the insulating section to be given a rounded outer contour, wherein projections are avoided. Convex outer sleeve surfaces enable an approximately rotationally symmetrical envelope of the insulating section to be guaranteed, thus resulting in an envelope which appears from the outside like a cylindrical sleeve. As an alternative to a rotationally symmetrical structure of this kind, edge regions, in particular the regions of the edges of the bodies between which a gap is formed, can be rounded or chamfered, thus forming conditions for the passage of a fluid at the gap which are favorable to flow. Furthermore, it is possible for the cross section of the partial sections to be bounded by a ring sector with approximately constant wall thickness due to differently curved inner and outer sleeve regions. The inner and outer sleeve region can also be curved around different axes, enabling the wall to have different wall thicknesses.

As an example, this enables sickle-shaped cross sections with wall thicknesses which decrease towards the edges of the body or with wall thicknesses which increase towards the edges of the body to be achieved. However, it can advantageously be provided that inner and outer sleeve surfaces of the partial sections are aligned coaxially with respect to one another. In particular, a coaxial alignment with respect to the longitudinal axis should be aimed for. This enables the structure of a tube with approximately constant wall thickness to be modeled by means of a plurality of partial sections, the tube structure being breached by at least one gap between edges of the bodies of the partial sections.

A further advantageous embodiment can provide that the partial sections are arranged symmetrically distributed about the longitudinal axis.

By arranging the partial sections symmetrically about the longitudinal axis, a plurality of gaps can be uniformly distributed in the circumferential direction of the insulating section. This promotes a good flow through or ventilation of the interior of the arc chamber.

It can be advantageous, for example, to use half shells which are arranged at a distance from one another, wherein the gaps on diametrically opposed sides of the insulating section are arranged aligned parallel with one another.

Furthermore, it can advantageously be provided that the number of gaps is equal to the number of partial sections.

The number of gaps can be easily varied by changing the number of partial sections and a corresponding arrangement. Furthermore, for example, different profiles in the course of the gap can be produced by an appropriate course of the edges of the bodies which border the gap. Advantageously, in doing so, the edges of the bodies of the adjacent partial sections should run approximately parallel to one another at a gap, thus bordering a uniformly extending gap of constant width. However, edges of the bodies of adjacent partial sections can also be designed differently from one another so that the course of the bounded gap can have different widths and/or take different courses. Furthermore, if the number of gaps and the number of partial sections correspond, it is easily possible to use a multiplicity of identical parts to form the insulating section. A single basic shape can advantageously be used to form the partial sections of an insulating section of an arc chamber. This reduces the expenditure on tools and the storage costs for keeping the partial sections available. The design of a plurality of gaps which are distributed in the circumferential direction of the insulating section is the same in each case.

A further advantageous embodiment can provide that a gap extends between the first and the second mounting body and is bounded at the ends thereby.

On the one hand, the gap can be bounded by edges of the bodies of the partial sections. If the gap now also runs from one mounting body to the other mounting body, the length of the gap is defined over the whole effective length of the insulating section. This enables the arc chamber to be penetrated by gaps over a large area along the longitudinal axis and enables flow to take place in and around the arc chamber in a simple manner. Furthermore, as a result of the gap running from mounting body to mounting body, a formation of discontinuities is avoided, as the gap can be penetrated over the whole length by an adequate amount of an insulating medium. When electrically insulating partial sections are butted together, it is advantageous to machine the butt joint appropriately in order to avoid discontinuities being produced at the butt joint and to create a surface which is as closed as possible.

As an alternative to an embodiment of this kind, the gap can also be bounded only by edges of the bodies of the partial sections, i.e. recesses, which are bounded by abutting partial sections and are fully encompassed thereby, are formed within the insulating section as a result of the design and profiling of the edges of the bodies.

Furthermore, it can advantageously be provided that the shells each have at least two sections of different radii of curvature.

Sections of the partial sections can be provided with different radii of curvature. On the one hand, it can be provided that an inner sleeve surface and an outer sleeve surface which extend in a radial direction lying one behind the other, have different radii of curvature so that the wall thickness of the partial sections in this region and of the different curves is not constant. However, it can also be provided that the sections with different radii of curvature are arranged distributed along the longitudinal axis, thus resulting in an envelope which has different radial extensions.

At the same time, it can advantageously be provided that the insulating section has a radially extended section in the centre.

A central bulge of the insulating section increases the accommodation space inside the arc chamber. It is therefore possible for the inner region of the arc chamber to have an increased volume so that the insulating medium inside the arc chamber can be kept available in sufficient quantity. The insulating medium can flow in and also flow out via the gap, enabling fresh, uncontaminated insulating medium to flow through the arc chamber at all times.

A further advantageous embodiment can provide that at least one end of each partial section is encompassed by a common ring electrode of a mounting.

An embodiment of a mounting with a ring electrode enables a triple point, at which electrically insulating material of the partial sections, electrically conductive material of a mounting body and an electrically insulating fluid medium converge, to be arranged in the shielding region of the ring electrode. As a result of the shielding effect of the electrode, the shielding region is free from fields, thus extensively preventing partial discharges at the triple point.

At the same time, an advantageous embodiment can provide that identical ring electrodes are arranged at both mountings, wherein the ring electrodes extend beyond the maximum radial extension of the electrical insulating insulating section. A bulge in the central section of the electrically insulating insulating section extends in the radial direction only to such an extent that the ring electrodes fully cover the insulating section. In a projection in the direction of the longitudinal axis, the ring electrodes completely overshadow the insulating section.

This guarantees that, in addition to a dielectric effect, the ring electrodes also guarantee a mechanical protection of the insulating material of the partial sections. In the assembled state of the arc chamber, i.e. the two mounting bodies are joined at the ends to the electrically insulating section, the arc chamber is set on a flat surface on the outer sleeve surface of the ring electrodes of the respective mounting body.

This enables an arc chamber to be easily packed and transported.

A further advantageous embodiment can provide that the partial sections are cast bodies, in particular insulating resin cast bodies.

As a recess is always arranged between two adjacent partial sections, the partial sections can be produced by simple casting methods. Simple molds, which are free from undercuts or similar, can be used, enabling the cast parts to be easily released or removed from the mold. In particular, when the sector size of the cross sections of the partial sections is chosen to be <180°, this results in easily formed bodies, as in cross section the edges of the bodies do not have undercuts on a full circle.

At the same time, insulating resin is particularly suitable, as this resin is insensitive to thermal influences and has a good insulation strength. In addition, insulating resins can be mechanically stressed and have a favorable ageing behavior. In order to additionally increase the mechanical strength, the insulating resin can be provided with armoring, for example in the form of glass fibers.

A further advantageous embodiment can provide that the gap runs substantially parallel to the longitudinal axis.

Parallel running with respect to the longitudinal axis can be achieved, for example, in that the gap runs in a straight line which is aligned parallel to the longitudinal axis. When a plurality of gaps is provided, these gaps should all be aligned parallel to one another and parallel to the longitudinal axis. In addition, it can also be provided that even though a plurality of gaps are aligned parallel to one another, they are skewed with respect to the longitudinal axis. Furthermore, it can also be provided that the course of the gap is arranged in any manner within the envelope of the partial sections. For example, a gap can also be formed between the partial sections in a spiral shape, curved, etc.

A further object of the invention is to specify a circuit breaker which makes use of the arc chamber described above. According to the invention, the object is achieved in that the circuit breaker has an arc chamber which has characteristics as claimed in one of claims 1 to 10, and has a switching path with switching contact pieces which can be moved relative to one another, wherein a switching path which is bounded by the switching contact pieces is encompassed by the insulating section of the arc chamber.

Switching contact pieces of a circuit breaker serve to form an electrical current path or an isolation of an electrical current path. For this purpose, the switching contact pieces can usually be moved relative to one another. Particularly when interrupting a current path, it is of advantage if a steady-state condition, i.e. a high insulation strength, is produced as quickly as possible in the switching path between the switching contact pieces by a fluid insulating medium. However, discharges, which can lead to a contamination of the fluid insulating medium, can occur during a switching operation. It is therefore necessary to provide an adequate volume of insulating medium, which can also be replaced or agitated in an adequate quantity and at an adequate speed at least during a switching operation, in the interior of the arc chamber. It is possible to channel out contaminated insulating medium from the interior of the arc chamber and allow fresh insulating medium to flow in via the gap within the arc chamber. Insulating liquids such as oil and insulating gases such as sulfur hexafluoride are suitable insulating media.

This makes it more difficult for a current, which is possibly to be interrupted when a current path is interrupted, to reignite in the form of an arc.

As a rule, the mounting bodies of the arc chamber can be designed as electrically conducting elements which can have different voltage potentials even when the circuit breaker is switched off, i.e. the switching path is electrically insulating. These different potentials are to be isolated from one another by means of the electrically insulating section of the arc chamber. At the same time, on the one hand, the electrically insulating section has the task of potential isolation, and on the other, the electrically insulating insulating section also serves to mechanically position the mounting bodies relative to one another. The two mounting bodies and the electrically insulating section form an angularly rigid interconnection.

Furthermore, it can advantageously be provided that a gap is arranged below the switching path in relation to a vertical line.

Arranging a gap below the switching path enables abrasions of contact material, particles etc., which occur in the switching path, to be easily fed out of the arc chamber. So-called particle traps, in which the abrasion etc. is collected within a space which is free from fields, can be arranged outside the arc chamber. Removing troublesome particles from the arc chamber is advantageous in order to not adversely affect the insulation strength of the electrically insulating insulating section. Depositing abrasion, combustion substances and the like on the surface of the electrically insulating insulating section would facilitate the formation of a creepage current path between the mounting bodies. Due to the curvature of the partial sections and a covering of a circular sector angle of not 180°, the interior of the electrically insulating section is free from undercuts which would encourage a depositing of abrasion or combustion products or other particles in the interior of the arc chamber.

Combustion, abrasion or other unwanted particles can fall out of the arc chamber assisted by gravity. Mechanical impacts and vibrations which may be produced during a switching operation can additionally assist this falling out.

As well as a trickling out of abrasion, combustion and other unwanted particles from the interior of the arc chamber, arranging a gap below the switching path also enables a replenishing flow of insulating fluid. Particularly when a further diametrically opposed gap is correspondingly arranged above the switching path, the possibly contaminated insulating medium can be guided out of the arc chamber. Particularly when an arc burns in the switching path, this results in a thermal effect which drives a heated insulating medium upwards through the gap situated above the switching path. This additionally assists a replenishing flow of uncontaminated insulating medium situated outside the arc chamber into the interior of the arc chamber. By this means, on the one hand, particles can be guided out of the arc chamber via the gap at the bottom and, on the other, an inflow of uncontaminated, usually cold insulating medium into the interior of the arc chamber can be effected via the lower gap. Here, this replenishing insulating medium may be heated and contaminated, for example by the effect of an arc, and then also flow out via a gap which may be situated above the switching path. Naturally, other gaps can also be used for the flowing in and flowing out of insulating fluid.

The invention is shown schematically below in a drawing with reference to an exemplary embodiment and subsequently described in more detail.

DESCRIPTION OF THE INVENTION

Figure 1:
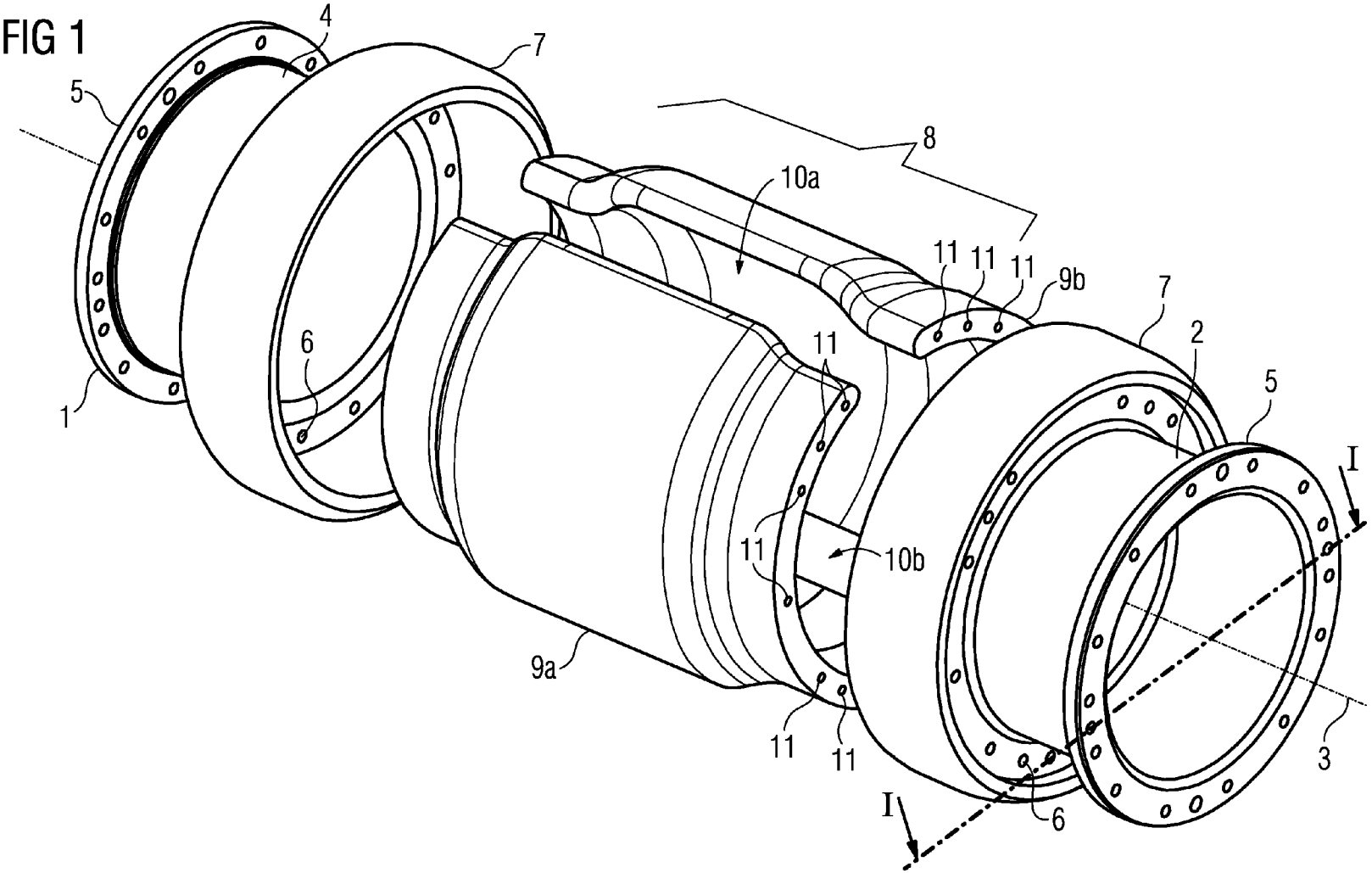
FIG. 1 shows a perspective view of an arc chamber in an exploded view.

FIG. 1 shows an arc chamber which has a first mounting body 1 and a second mounting body 2. The two mounting bodies 1, 2 are identical and as such are designed rotationally symmetrically. The axes of rotation of the mounting bodies 1, 2 are arranged coaxially with respect to one another and define a longitudinal axis 3 of the arc chamber. The construction of the mounting bodies 1, 2 is described below by way of example with reference to the first mounting body 1. The first mounting body 1 has a tubular connector 4. The tubular connector 4 is designed as a hollow cylinder and has a substantially constant wall thickness. A flange 5 is connected to the tubular connector 4 at its end which faces away from the second mounting body 2. A plurality of penetrating recesses is arranged in the flange 5. The first mounting body 1 can be connected to further components of a circuit breaker by means of the flange 5, enabling the arc chamber to be positioned by means of the flange 5. The tubular connector 4 is provided with a circumferential land 6 at its end which faces the second mounting body 2. The circumferential land 6 borders the tubular connector 4.

A ring electrode 7 is fitted to the outer circumference of the land 6. The ring electrode 7 has a toroidal rounded structure at its outer circumference. At the same time, the ring electrode 7 covers the land 6 both in a radial direction and also on both sides in an axial direction with respect to the axis of rotation of the first mounting body 1. A plurality of recesses is provided in the land 6, by means of which further components can be fixed to the land 6. The land 6 together with the recesses arranged in the land 6 lies in the shielding region of the ring electrode 7. It is therefore possible to fit screws, for example, in the recess of the land 6 within the shielding region of the ring electrode 7, wherein the screw heads and the screw shafts are shielded by the ring electrode 7.

The first mounting body 1 is preferably made from an electrically conducting material, for example aluminum or copper, wherein the first mounting body 1 is preferably a cast body, which would possibly be retrospectively machined in order to introduce recesses, for example, and to remove casting burrs.

The first mounting body 1 and the second mounting body 2 are identical and are arranged offset with respect to one another in opposite directions on the longitudinal axis 3 so that the two ring electrodes 7 of the first mounting body 1 and the second mounting body 2 face one another, and the ends of the first mounting body 1 and the second mounting body 2 with the respective flanges 5 point away from one another.

As well as the two mounting bodies 1, 2, the arc chamber has an electrically insulating insulating section 8. Here, the insulating section 8 has a first shell-shaped partial section 9*a* and a second shell-shaped partial section 9*b*. The two shell-shaped partial sections 9*a*, 9*b* are identical parts which have been cast by means of a casting process. Preferably, the two partial sections 9*a*, 9*b* are cast resin bodies. The two partial sections 9*a*, 9*b* are each shell-shaped, wherein the partial sections 9*a*, 9*b* are aligned substantially coaxially with respect to the longitudinal axis 3 and have a virtually constant wall thickness, so that the two partial sections 9*a*, 9*b* border a rotationally symmetrical envelope of the insulating section 8. The envelope is aligned coaxially with respect to the longitudinal axis 3. On the face side, the partial sections 9*a*, 9*b* have a circular-sector-shaped cross section, wherein the sector angle is less than 180°, thus forming a first gap 10*a* and a second gap 10*b* between the mutually opposing edges of the bodies of the partial sections 9*a*, 9*b*. The two gaps 10*a*, 10*b* lie in the envelope on diametrically opposite sides with respect to the longitudinal axis 3. The gaps 10*a*, 10*b* have a linear course which is aligned parallel to the direction of the longitudinal axis 3. The gaps 10*a*, 10*b* extend through the whole insulating section 8, wherein the gap widths are approximately constant.

Internal threads 11 are cut in the faces of the shell-shaped partial sections 9*a*, 9*b*, which can alternatively be referred to as trough-shaped. The position of the internal threads 11 corresponds to the recesses in the lands 6 of the mounting bodies 1, 2, enabling a screw to be inserted through a recess of a land 6, wherein an angularly rigid interconnection between the partial sections 9*a*, 9*b* and the mounting bodies 1, 2 can be made by means of threads of the screws which engage with the internal threads 11. Screwing the mounting bodies 1, 2 to the partial sections 9*a*, 9*b* of the insulating section 8 produces an angularly rigid interconnection of the arc chamber. To increase stability, the threads 11 can be made in dowels which are inserted into the faces of the partial sections 9*a*, 9*b*. The screws with screw head and screw shaft and also the dowels are sized in such a way that they are located within the shielding region of the respective ring electrodes 7 (cf. FIG. 2).

The shell-shaped partial sections 9*a*, 9*b* are designed in such a way that a section, which has a greater radius of curvature than the sections of the partial sections 9*a*, 9*b* which are located at the ends, is formed in the centre. As a result, a central radially extended space, which can be used to accommodate switching contact pieces of a circuit breaker, is formed on the arc chamber.

Figure 2:
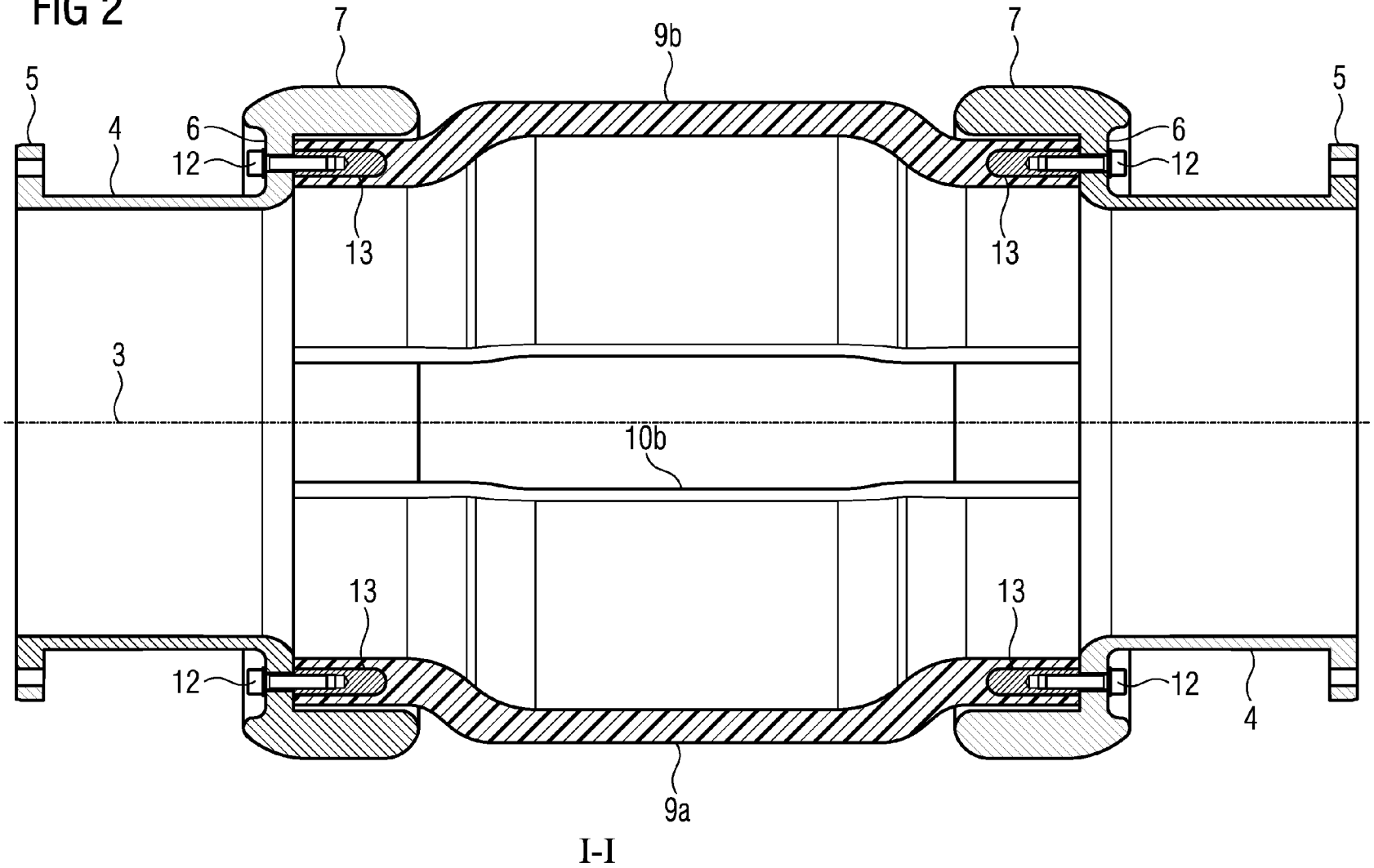
FIG. 2 shows a longitudinal section through the arc chamber disclosed in FIG. 1 in the assembled state.

A longitudinal section through the arc chamber disclosed in FIG. 1 in the assembled state is shown in FIG. 2. Here, the section plane corresponds to the section plane I-I shown in FIG. 1.

FIG. 2 shows, by way of example, screws 12 which are screwed into dowels 13 in the partial sections 9*a*, 9*b*, thus forming an angularly rigid interconnection between the mounting bodies 1, 2 and the insulating section 8. At the same time, the inside diameter of the ring electrodes 7 is sized in such a way that, in the state of the angularly rigid interconnection of the partial sections 9*a*, 9*b* with the mounting bodies 1, 2, an annular gap, which can be filled with a fluid insulating medium, remains between the outer sleeve surface of the partial sections 9*a*, 9*b* which are encompassed by the ring electrodes 7 and an inner sleeve surface of the ring electrodes 7.

The triple point between the insulating material of the ends of the partial sections 9*a*, 9*b* and the metallic material of the mounting bodies 1, 2 and the insulating medium is therefore arranged in a dielectrically shielded shield region of the ring electrodes 7. The ring electrodes 7 are extended in a radial direction in such a way that the outer surfaces of the ring electrodes 7 define the point of the arc chamber which is furthest in a radial direction from the longitudinal axis 3. The central radially extended section of the insulating section 8 is therefore protected by the ring electrodes 7.

The gap 10*a* and the gap 10*b* extend linearly through the whole insulating section 8, so that the gaps 10*a*, 10*b* are bounded in the circumferential direction by edges of the bodies of the partial sections 9*a*, 9*b*, whereas the gaps 10*a*, 10*b* are bounded in the axial direction by the mounting bodies 1, 2. The gaps 10*a*, 10*b* have a linear course in the direction of the longitudinal axis 3 and have a constant width. The shape and position of the gap 10*a*, 10*b* is defined by the mutually facing edges of the bodies of the adjacent partial sections 9*a*, 9*b* of the insulating section 8 in each case. In the present case, the edges of the bodies which border the gap 10*a*, 10*b* are rounded, thus avoiding projections and corners, which, under the effect of high electrical voltages, could lead to the production of partial discharges. The radially extended central section of the insulating section 8 is provided to accommodate switching contact pieces of a circuit breaker in its interior.

Figure 3:
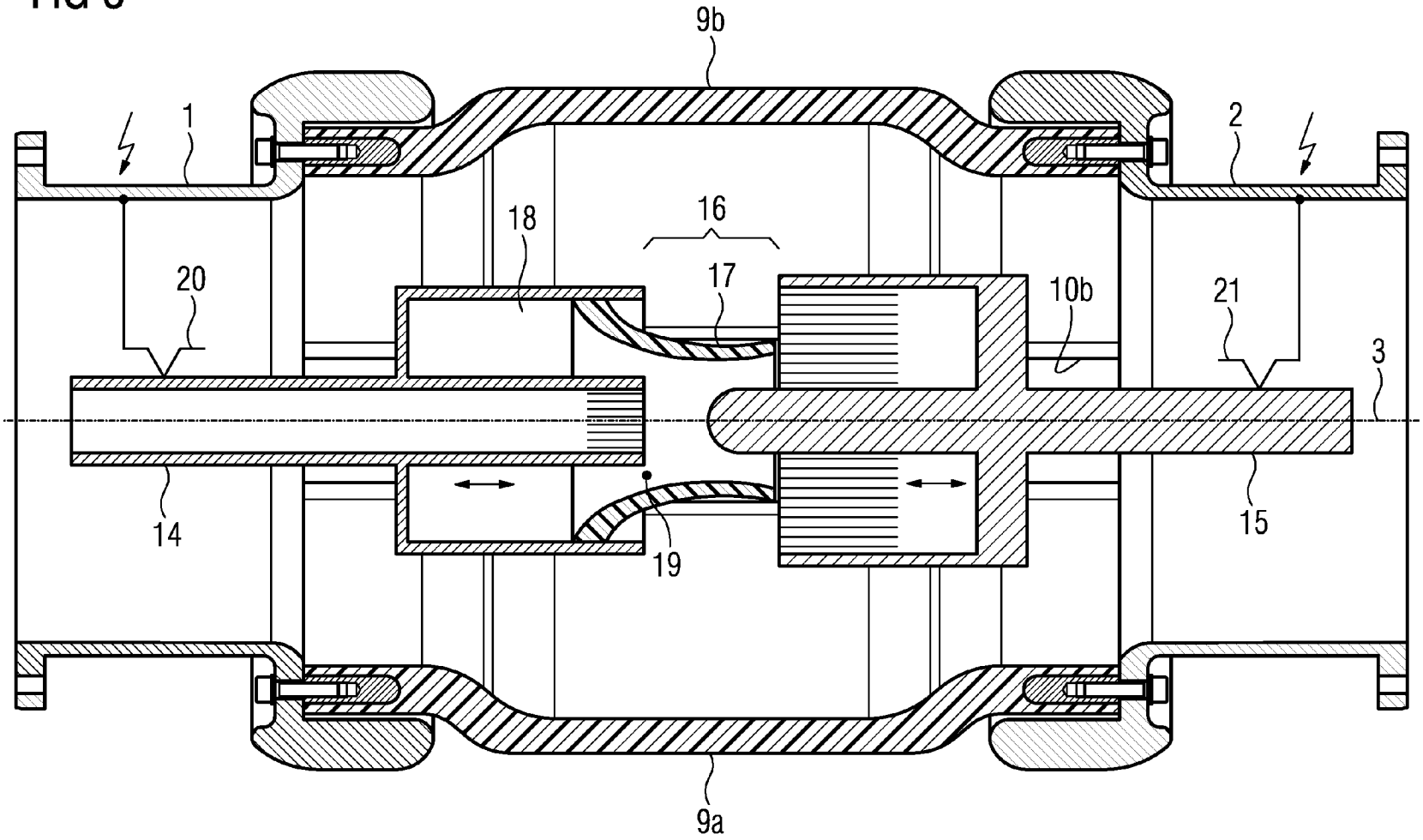
FIG. 3 shows the longitudinal section disclosed in FIG. 2 supplemented by the addition of switching contact pieces and further components of a circuit breaker.

FIG. 3 shows the longitudinal section disclosed in FIG. 2 of an arc chamber, wherein the arc chamber has been supplemented by switching contact pieces of a circuit breaker. The mounting bodies 1, 2 are part of a current path which can be interrupted or made by a circuit breaker. The first mounting body 1 can be connected to a first electrical conductor $\mathfrak{L}$. The second mounting body 2 can be connected to a second electrical conductor $\mathfrak{L}$. A first switching contact piece 14 and a second switching contact piece 15 are arranged in the interior of the arc chamber. The two switching contact pieces 14, 15 each have an arc contact piece and a rated current contact piece. The two arc contact pieces lead the rated current contact pieces during a switch-on operation, whereas, during a switch-off operation, the two rated current contact pieces open first and the two arc contact pieces are then isolated from one another. The two switching contact pieces 14, 15 can be moved relative to one another along the longitudinal axis 3. In doing so, it can be provided that only one of the switching contact pieces 14, 15 or both of the switching contact pieces 14, 15 are movable. The arc contact piece of the first switching contact piece 14 is tubular in design and is designed as a socket-shaped contact element with elastically deformable contact fingers at its end which faces the second switching contact piece 15. On the opposite side, the arc contact piece of the second switching contact piece 15 is designed in the form of a bolt which correspondingly can be inserted into the socket of the arc contact piece of the first switching contact piece 14. The rated current contact pieces always carry the same electrical potential as the arc contact pieces on the same switching contact piece 14, 15 in each case. At the same time, the rated current contact pieces in each case encompass the arc contact pieces in a radial direction, the rated contact piece of the first switching contact piece 14 being provided with a cylindrical outer sleeve surface against which elastically deformable contact fingers of the rated current contact piece of the second switching contact piece 15 can be driven. The arc contact pieces project beyond the rated current contact pieces, which respectively carry the same potential, in the direction of the other switching contact piece 14, 15 in each case, thus, in a simple manner, providing a leading of the arc contact pieces with respect to the rated current contact pieces during a switch-on operation and a lagging of the arc contact pieces with respect to the rated current contact pieces during a switch-off operation.

A switching path 16 is formed between the two switching contact pieces 14, 15. The switching path 16 is spanned in a radial direction by the partial sections 9*a*, 9*b* of the insulating section 8. The gap 10*b* is arranged below the switching path 16, i.e. in the fitted state the section plane of FIG. 3 lies horizontally so that a perpendicular to the drawing plane of FIG. 3 protrudes vertically. The second gap 10*a* is therefore arranged above the switching path 16 with respect to the perpendicular.

The switching path 16 is encompassed by an insulating material nozzle 17 which encompasses the arc contact pieces and is itself encompassed by the rated current contact pieces, at least in the switched-on state. A switching gas buffer volume 18 is located within the rated current contact piece of the first switching contact piece 14. A connection from the switching gas buffer volume 18 to a constriction of the insulating material nozzle 17 is provided by means of a switching gas channel 19.

The arc chamber shown in FIG. 3 is typically arranged within an encapsulated housing of a circuit breaker. The encapsulated housing encompasses the arc chamber and forms a hermetically sealed space. This hermetically sealed space is filled with a fluid insulating medium, for example an insulating oil or an insulating gas. Particularly when an insulating gas is used, a pressure increase inside the hermetically sealed space is desirable in order to additionally increase the insulation strength of the gaseous insulating fluid.

A switch-off operation of a circuit breaker is described in principle below. In the switched-on state, the arc contact pieces and the rated current contact pieces of the first and second switching contact piece 14, 15 are galvanically connected to one another. An electrically conducting connection of the two switching contact pieces 14, 15 to the two mounting bodies 1, 2 and therefore to the conductors 4, 4 connected to the mounting bodies 1, 2 is provided by means of sliding contact arrangements 20, 21. The switching contact pieces 14, 15 are now moved away from one another to produce an electrically insulating isolating point. In doing so, the first switching contact piece 14 and the second switching contact piece 15 are moved away from one another in opposite directions in the direction of the longitudinal axis 3. The rated current contact pieces of the first switching contact piece 14 and the second switching contact piece 15 separate first, while the two arc contact pieces are still engaged with one another. An electric current driven via the current path commutates to the arc contact pieces. The two arc contact pieces of the first switching contact piece 14 and the second switching contact piece 15 then also separate.

The arc contact piece of the second switching contact piece 15 plugs the insulating material nozzle 17. As a rule, an arc is formed during a switch-off operation due to the potential difference which exists between the two switching contact pieces. The arc heats insulating fluid in the arc chamber and produces switching gas. As the insulating material nozzle 17 is plugged, these switching gases can escape in the direction of the tubular first switching contact piece 14.

Switching gas can also escape into the switching gas buffer volume 18 via the switching gas channel 19. Switching gas flows into the switching gas buffer volume 18 as a result of the thermal energy and the sizing of switching gas buffer volume 18 and switching gas channel 19. As a result of a continuing flow of switching gas, the pressure in the switching gas buffer volume 18 increases. Switching gas is prevented from flowing back from the switching gas buffer volume 18 via the switching gas channel 19 due to the arc and the plugged insulating material nozzle 17. The insulating material nozzle 17 is not opened by the arc contact piece of the second switching contact piece 15 until the relative movement between first and second switching contact piece 14, 15 proceeds. Switching gas which has been buffered in the switching gas buffer volume 18 can now flow into the insulating material nozzle 17 via the switching gas channel 19 due to the increased pressure. Any arc which is still burning there is blown and therefore cooled. Furthermore, the switching path 16 is also cleared of contaminated switching gas by such a blowing action. Residual abrasion or combustion products which have been produced can also be blown out in the course of a movement due to the flow conditions within the switching path.

Fresh insulating medium or hot contaminated insulating medium/switching gas can flow in and out respectively via the gap 10*a*, 10*b*. Furthermore, abrasion or combustion products can fall out of the arc chamber via the bottom gap 10*b*. As a result of the thermal conditions which are established, cool insulating gas can flow in from below via the gap 10*a*, 10*b*, driven by temperature differences, and hot switching gas can flow out via the upper gap 10*a*. When the first and second switching contact pieces 14, 15 have reached their switch-off end positions, a potential isolation exists between these switching contact pieces 14, 15, i.e. a current path and a current that may have been flowing through the current path have been interrupted in the arc chamber of the circuit breaker.

The invention claimed is:

1. An arc chamber for a circuit breaker, comprising:

an electrically insulating insulating section;

first and second mounting bodies respectively disposed at each end, referred to a longitudinal axis of the arc chamber, of said electrically insulating insulating section;

said insulating section having at least two shell-shaped partial sections each curved concavely with respect to the longitudinal axis, said partial sections defining a wall of the arc chamber, and said partial sections having edges spaced apart from one another to thereby form at least one gap in said insulating section between said partial sections.

2. The arc chamber according to claim 1, wherein said partial sections are formed with convex outer sleeve surfaces together defining a rotationally symmetrical envelope between said first and second mounting bodies.

3. The arc chamber according to claim 1, wherein said partial sections are symmetrically distributed about the longitudinal axis.

4. The arc chamber according to claim 1, wherein said at least one gap is one of a plurality of gaps, and a number of said gaps is equal to a number of partial sections.

5. The arc chamber according to claim 1, wherein said at least one gap extends between said first and second mounting bodies and is bounded by said mounting bodies.

6. The arc chamber according to claim 1, wherein each of said partial sections has at least two segments of mutually different radii of curvature.

7. The arc chamber according to claim 1, wherein said insulating section has a radially extended section in a center thereof.

8. The arc chamber according to claim 1, wherein at least one end of each said partial section is encompassed by a common ring electrode of a respective said mounting body.

9. The arc chamber according to claim 1, wherein said partial sections are cast bodies.

10. The arc chamber according to claim 9, wherein said cast bodies are insulating resin cast bodies.

11. The arc chamber according to claim 1, wherein said at least one gap runs substantially parallel to the longitudinal axis.

12. A circuit breaker, comprising:

an arc chamber according to claim 1;

a switching path with switching contact pieces disposed to be moved relative to one another, wherein a switching path that is bounded by said switching contact pieces is encompassed by said insulating section of said arc chamber.

13. The circuit breaker according to claim 12, wherein a gap is arranged vertically below said switching path.

14. An arc chamber for a circuit breaker, comprising:

an electrically insulating insulating section;

first and second mounting bodies respectively disposed at each end, referred to a longitudinal axis of the arc chamber, of said electrically insulating insulating section;

said insulating section having at least two shell-shaped partial sections each curved concavely with respect to the longitudinal axis, and said partial sections having edges spaced apart from one another to thereby form at least one gap in said insulating section between said partial sections, said gap enabling removal of contaminated insulating medium from an interior of the arc chamber and a replenishing flow of fresh insulating medium into the interior of the arc chamber.

* * * * *